US006648492B1

(12) United States Patent
Shih

(10) Patent No.: US 6,648,492 B1
(45) Date of Patent: Nov. 18, 2003

(54) CONNECTABLE ILLUMINATIVE ASSEMBLY HAVING SUCTION CUPS

(76) Inventor: Jen Hsieh Shih, P.O. Box 63-298, Taichung (TW), 406

( * ) Notice: Subject to any disclaimer, the term of this patent is extended or adjusted under 35 U.S.C. 154(b) by 0 days.

(21) Appl. No.: 10/186,404

(22) Filed: Jun. 28, 2002

(51) Int. Cl.[7] ..... F21V 21/092
(52) U.S. Cl. ..... 362/397; 362/226; 362/249
(58) Field of Search ..... 362/397, 249, 362/382, 226; 439/505, 679

(56) References Cited

U.S. PATENT DOCUMENTS 1,933,965 A * 11/1933 Carlson ..... 362/486
1,956,273 A * 4/1934 Cleburne ..... 362/397
3,504,169 A * 3/1970 Freeburger ..... 362/249
5,311,417 A 5/1994 Heh ..... 362/397
5,816,849 A * 10/1998 Schmidt ..... 439/505
6,367,952 B1 4/2002 Gibboney, Jr. ..... 362/249
2002/0154512 A1 * 10/2002 Shy ..... 362/503

* cited by examiner

*Primary Examiner*—Sandra O'Shea
*Assistant Examiner*—Hargobind S. Sawhney

(57) ABSTRACT

An illuminative device includes a number of light devices each having a circuit board secured to a sucker member, a light member secured to the circuit board, a coupler attached to the circuit board, and another coupler coupled to the circuit board with electric wires. The couplers may be connected together to various lengths for attaching onto various object. The light devices may be changed with each other for changing the damaged light devices with the new ones. The sucker members may be used for detachably attaching the light devices onto various smooth objects.

5 Claims, 3 Drawing Sheets

CONNECTABLE ILLUMINATIVE ASSEMBLY HAVING SUCTION CUPS

BACKGROUND OF THE INVENTION

1. Field of the Invention

The present invention relates to an illuminative assembly, and more particularly to an illuminative assembly having a number of light devices selectively connectable together and attachable onto various objects with sucker members.

2. Description of the Prior Art

Various kinds of typical illuminative devices have been developed for decorative purposes, such as for decorating Christmas trees and homes. One example of the typical illuminative devices is disclosed in U.S. Pat. No. 6,367,952 to Gibboney, Jr., and comprises a number of light devices solidly and electrically coupled together with electric wires.

The light members of some of the typical illuminative devices are coupled together in series, such that the other light members may not be used when either of the light members has been damaged. In addition, the strings of the typical illuminative devices have a predetermined length which may not be adjusted according to different objects. Furthermore, the typical illuminative devices may not be easily attached onto smooth objects, such as the windows of vehicles, or the like.

U.S. Pat. No. 5,311,417 to Heh discloses another typical illuminative device which also comprises a number of light members solidly and electrically coupled together with electric wires, and which includes a number of suckers for attaching the light members onto smooth objects.

Similarly, the light members of the typical illuminative devices are coupled together in series, such that the other light members may not be used when either of the light members has been damaged. In addition, the strings of the typical illuminative devices have a predetermined length which may not be adjusted according to different objects.

The present invention has arisen to mitigate and/or obviate the afore-described disadvantages of the conventional illuminative devices.

SUMMARY OF THE INVENTION

The primary objective of the present invention is to provide an illuminative assembly including a number of light devices selectively connectable together to different lengths according to the objects to be attached thereon.

The other objective of the present invention is to provide an illuminative assembly including a number of sucker members for detachably attaching the light devices onto various smooth objects.

In accordance with one aspect of the invention, there is provided an illuminative assembly comprising a plurality of light devices each including a sucker member, a circuit board secured to the sucker member, a light member secured to the circuit board, a first coupler attached to the circuit board, and a second coupler coupled to the circuit board with at least one electric wire. The second couplers of the light devices are connectable to the first couplers of the other light devices, for coupling the light devices together, and for allowing the light devices to be coupled together to various lengths, and for allowing the light devices to be replaced or changed with the other ones.

The sucker members each includes a peripheral wall extended therefrom for supporting the circuit boards respectively, and each includes at least two notches formed therein for receiving the first coupler and the electric wire respectively, and for allowing the first coupler and the electric wire to be extended out of the peripheral wall.

The peripheral walls of the sucker members each includes at least two channels formed therein and communicating with the notches respectively for receiving the first coupler and the electric wire respectively, and each includes a chamber formed therein for receiving the circuit board.

A housing may further be provided and engaged onto the peripheral wall for retaining the circuit board and the light member on the peripheral wall. The housing includes at least two grooves formed therein for receiving the first coupler and the electric wire respectively, and for allowing the first coupler and the electric wire to be extended out of the housing.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
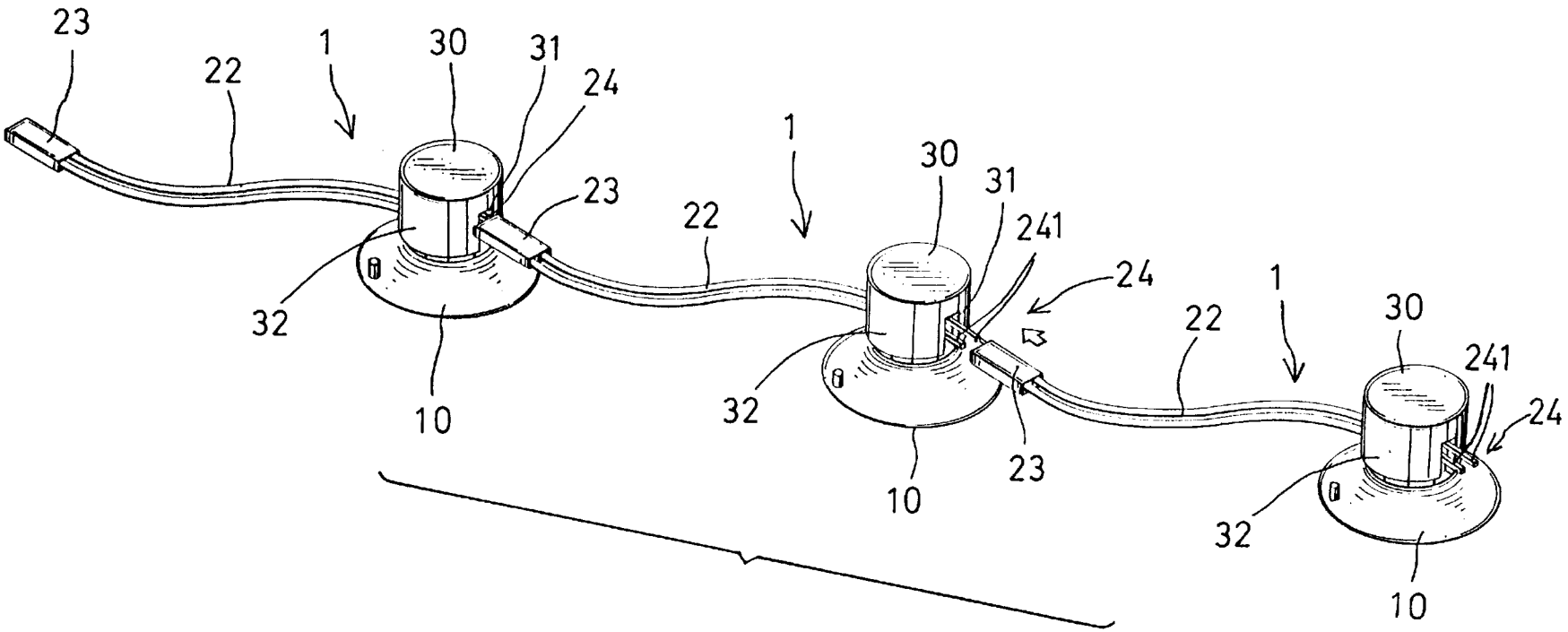
FIG. 1 is a partial exploded view of an illuminative assembly in accordance with the present invention.

Referring to the drawings, an illuminative assembly in accordance with the present invention comprises a number of light devices 1 that may be coupled together to form a light string or the like, for attaching onto various objects, and for decorative purposes, such as for decorating Christmas trees and homes.

The light devices 1 of the illuminative assembly each includes a sucker member 10 having a peripheral wall 11 extended therefrom, and having a chamber 12 formed in the peripheral wall 11, and having one or more notches 13 formed in the upper portion or the free end portion of the peripheral wall 11, and having one or more channels 14 formed in the outer peripheral portion of the peripheral wall 11, and communicating with the notches 13 and the chamber 12 of the sucker member 10 respectively.

A circuit board 20 is received in the chamber 12 of the sucker member 10, or engaged on top of the peripheral wall 11, and includes a light member 21 secured thereto and received in the chamber 12 of the sucker member 10, and includes a socket or a plug or a coupler 24 attached thereto and having one or two prongs 241, and includes a plug or a socket or another coupler 23 coupled thereto with one or more electric wires 22.

The prongs 241 of the coupler 24 and/or the electric wires 22 of the circuit board 20 may be extended out of the peripheral wall 11 via the notch 13 and/or the channel 14 of the peripheral wall 11. The couplers 23, 24 of the light devices 1 may be selectively and adjustably secured or coupled together to various lengths according to the widths or lengths of the objects to be decorated with the illuminative assembly.

Figure 2:
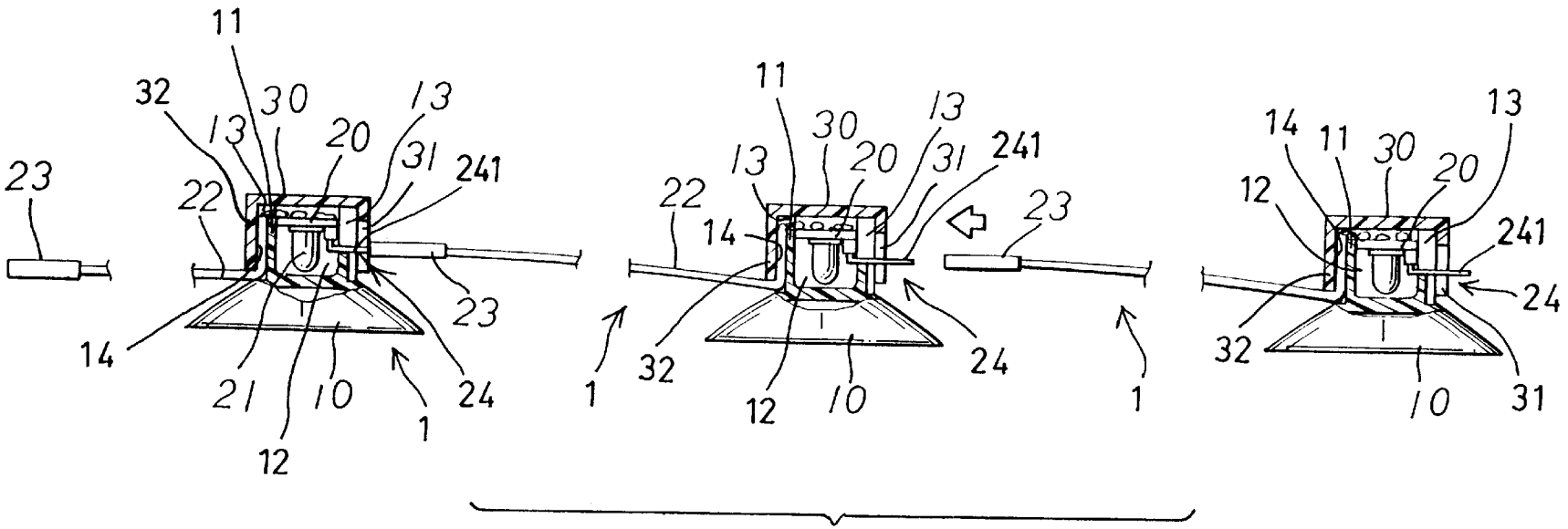
FIG. 2 is a partial cross sectional and exploded view of the illuminative assembly.
Figure 4:
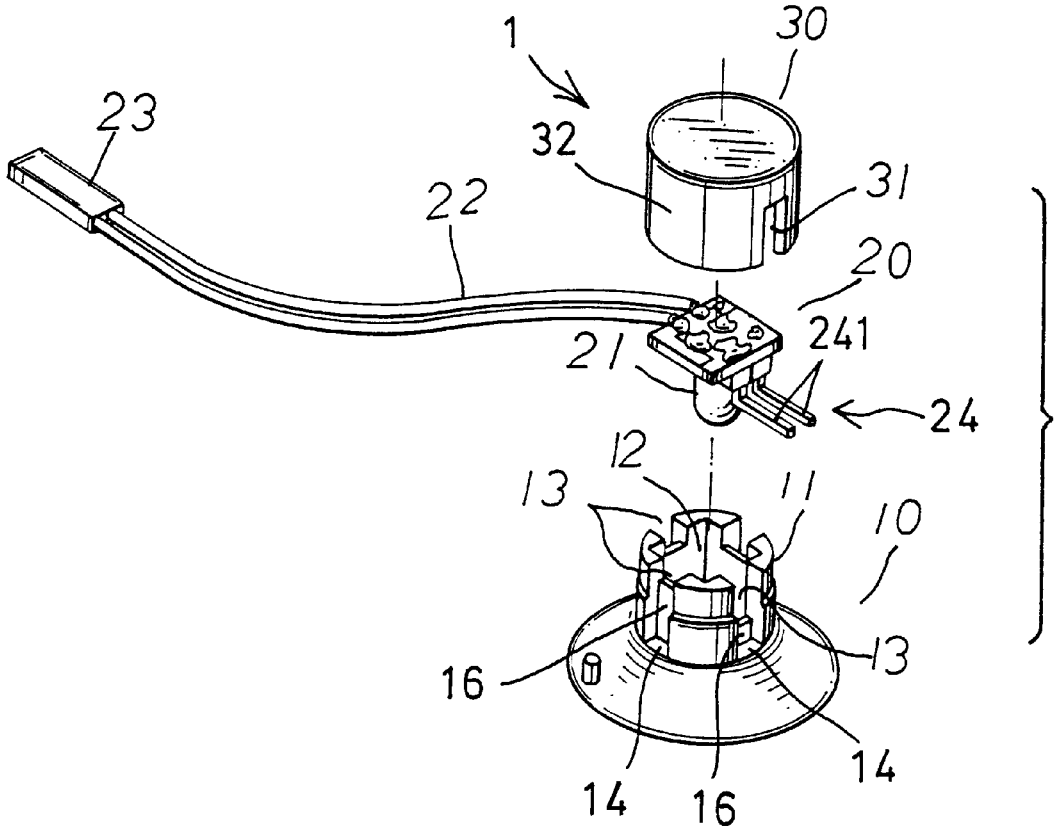
FIG. 4 is an exploded view showing one of the light devices of the illuminative assembly.
Figure 3:
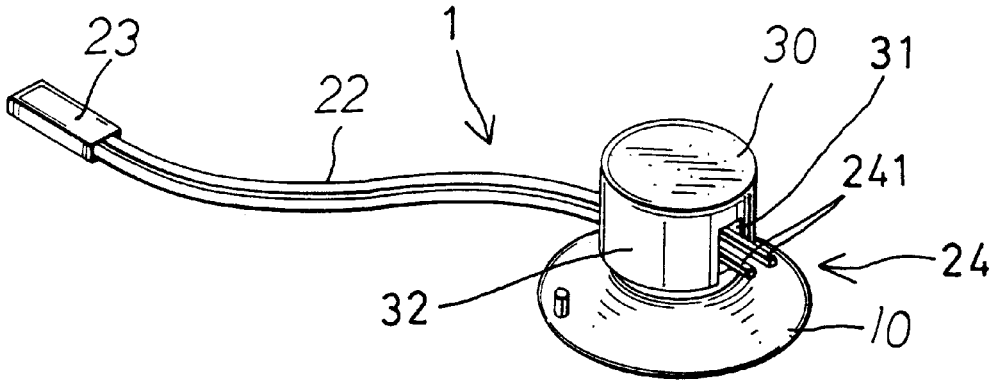
FIG. 3 is a perspective view showing one of the light devices of the illuminative assembly.

A housing 30 may further be provided and includes one or more grooves 31 formed in a peripheral fence 32 thereof for aligning with the channels 14 and/or notches 13 of the peripheral wall 11, and for allowing the coupler 24 and the electric wires 22 to be engaged or extended out of the housing 30, best shown in FIG. 2. The housing 30 may be force-fitted onto the peripheral wall 11, or may be secured to the peripheral wall 11 with adhesive materials, fasteners, or by welding processes, for retaining the circuit board 20 and the light member 21 in the peripheral wall 11.

It is to be noted that the peripheral wall 11 and the housing 30 may be solidly secured together and formed into an integral one piece if the peripheral wall 11 and the housing 30 are solidly secured together by welding processes. Alternatively, the circuit board 20 may also be engaged or molded into the peripheral wall 11 and/or the housing 30 by molding processes, and the coupler 24 and the electric wires 22 may be arranged and extended out of the peripheral wall 11 and/or the housing 30 with the molding processes.

It is to be noted that the light devices 1 may be selectively connected together and may be adjustably coupled together to different lengths according to the widths or the lengths or the other dimensions of the objects to be decorated with the illuminative assembly. In addition, the light devices may be detachably attached onto various smooth objects with the sucker members, such as attached onto the windows of the vehicles for generating warning lights. Furthermore, when one or some of the light devices have been damaged, the damaged light devices may be easily disengaged from the other light devices and may be quickly replaced with the other light devices, such that the other light devices that have not been damaged may still be used and need not be discarded away.

Accordingly, the illuminative assembly in accordance with the present invention includes a number of light devices selectively connectable together to different lengths according to the objects to be attached thereon, and includes a number of sucker members for detachably attaching the light devices onto various smooth objects.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An illuminative assembly comprising:

a plurality of light devices each including a sucker member, a circuit board secured to said sucker member, a light member secured to said circuit board, a first coupler attached to said circuit board, and a second coupler coupled to said circuit board with at least one electric wire, said sucker members of said light devices each including a peripheral wall extended therefrom for supporting said circuit boards respectively, said peripheral walls of said sucker members each including at least two notches formed therein for receiving said first coupler and said at least one electric wire respectively, and for allowing said first coupler and said at least one electric wire to be extended out of said peripheral wall, and said second couplers of said light devices being connectable to said first couplers of the other light devices, for coupling said light devices together, and for allowing said light devices to be coupled together to various lengths.

2. The illuminative assembly according to claim 1, wherein said peripheral walls of said sucker members each includes at least two channels formed therein and communicating with said at least two notches respectively for receiving said first coupler and said at least one electric wire respectively.

3. The illuminative assembly according to claim 1, wherein said peripheral walls of said sucker members each includes a chamber formed therein for receiving said circuit board.

4. The illuminative assembly according to claim 1 further comprising a housing engaged onto said peripheral wall for retaining said circuit board and said light member on said peripheral wall.

5. The illuminative assembly according to claim 4, wherein housing includes at least two grooves formed therein for receiving said first coupler and said at least one electric wire respectively, and for allowing said first coupler and said at least one electric wire to be extended out of said housing.

* * * * *